US007114997B2

(12) United States Patent
Sagawa et al.

(10) Patent No.: US 7,114,997 B2
(45) Date of Patent: Oct. 3, 2006

(54) ELECTRICAL CONNECTOR

(75) Inventors: Tetsuya Sagawa, Kodaira (JP); Toshiaki Kono, Inagi (JP); Takahiro Yoneda, Sagamihara (JP); Ryo Sawada, Isehara (JP)

(73) Assignee: Tyco Electronics Amp K.K., Kanagawa-ken (JP)

( * ) Notice: Subject to any disclaimer, the term of this patent is extended or adjusted under 35 U.S.C. 154(b) by 0 days.

(21) Appl. No.: 10/963,904

(22) Filed: Oct. 13, 2004

(65) Prior Publication Data

US 2005/0090148 A1 Apr. 28, 2005

(30) Foreign Application Priority Data

Oct. 16, 2003 (JP) ..... 2003-356657

(51) Int. Cl.
*H01R 13/436* (2006.01)

(52) U.S. Cl. ..... 439/752; 439/595

(58) Field of Classification Search ..... 439/595, 439/752

See application file for complete search history.

(56) References Cited

U.S. PATENT DOCUMENTS 5,575,683 A 11/1996 Saito et al.
5,830,013 A * 11/1998 Saito et al. ..... 439/595
5,931,700 A 8/1999 Saito et al.
6,488,541 B1 * 12/2002 Takeuchi ..... 439/660
6,739,882 B1 * 5/2004 Fuehrer et al. ..... 439/95
2002/0168895 A1 * 11/2002 Suzuki ..... 439/595
2005/0090148 A1 * 4/2005 Sagawa et al. ..... 439/595
2005/0124216 A1 * 6/2005 Sagawa et al. ..... 439/595

FOREIGN PATENT DOCUMENTS

EP 0 967 688 A1 12/1999
JP 09-161875 6/1997
JP 2001-332335 11/2001
JP 2002-260766 9/2002

* cited by examiner

*Primary Examiner*—James R. Harvey
(74) *Attorney, Agent, or Firm*—Barley Snyder, LLC

(57) ABSTRACT

An electrical connector includes an insulating housing and a retainer. The housing has a plurality of contact accommodating cavities. The retainer is moveable between a temporary locking position and a main locking position. The retainer has first retainer arms that extend into a front surface of the housing. The first retainer arms have a second locking member formed on a top surface in a vicinity of a free end of the first retainer arms and a third locking member formed on a bottom surface in substantially a center of the first retainer arms. The second and third locking members are configured to abut the housing in the temporary locking position so that the retainer is prevented from moving from the temporary locking position to the main locking position.

21 Claims, 11 Drawing Sheets

ELECTRICAL CONNECTOR

FIELD OF THE INVENTION

The invention relates to an electrical connector having a housing and a retainer that is moveable from a temporary locking position to a main locking position within the housing.

BACKGROUND OF THE INVENTION

FIGS. 10, 11A, and 11B (Japanese Patent Application Kokai No. H9-161875) show a first conventional electrical connector 101. The electrical connector 101 includes an insulating housing 110. The housing 110 includes a contact accommodating member 111 having a plurality of contact accommodating cavities (not shown) for receiving contacts (not shown). A hood 112 extends forward from the contact accommodating member 111. Each of the contact accommodating cavities (not shown) has a first locking arm (not shown) for initially locking the contacts in the housing 110. A flexible second locking arm 113 extends forward from the contact accommodating member 111 and is disposed inside the hood 112 of the housing 110. The second locking arm 113 has a locking member 114.

A retainer 120 that secures the contacts (not shown) in the housing 110 is inserted from a front surface (left side in FIG. 10) of the housing 110 into the hood 112. The retainer 120 can be locked to the housing 110 in a temporary locking position shown in FIG. 11A that allows insertion of the contacts (not shown) into the contact accommodating cavities (not shown) and in a main locking position shown in FIG. 11B that secures the contacts (not shown) in the housing 110. The retainer 120 has a first locking projection 121 and a second locking projection 122. The first locking projection 121 prevents the retainer 120 from being pulled in a forward direction toward the front surface of the housing 110 when the retainer 120 is in the temporary locking position. The second locking projection 122 contacts a front surface of the locking member 114 when the retainer 120 is in the temporary locking position, as shown in FIG. 11A, so that the retainer 120 is prevented from being pushed in toward a rear of the housing 110 when the retainer 120 is in the temporary locking position. The second locking projection 122 is positioned to a rear of the locking member 114 when the retainer 120 is in the main locking position, as shown in FIG. 11B, so that the retainer 120 is prevented from being pulled in the forward direction toward the front surface of the housing 110.

FIGS. 12A to 12F (Japanese Patent Application Kokai No. 2001-332335) show a second conventional electrical connector 201. The electrical connector 201 includes an insulating housing 210. A plurality of contact accommodating cavities (not shown) for receiving contacts (not shown) is formed in the housing 210. A locking arm (not shown) for initially locking the contacts (not shown) in the housing 210 is disposed inside each of the contact accommodating cavities (not shown). A retainer insertion opening 216 for inserting a retainer 220 is formed in the housing 210. First locking members 213 are formed on rear portions (left portion in FIG. 12A) of the retainer insertion openings 216. Second locking members 214 are formed on front portions of the retainer insertion openings 216 in positions lower than the first locking members 213. As shown in FIG. 12B, first locking openings 211 and second locking openings 212 are formed in both side walls of the housing 210.

The retainer 220 is constructed so that it is inserted into the retainer insertion opening 216 from a top surface (upper side in FIG. 12A) of the housing 210 to double-lock the contacts (not shown). As shown in FIG. 2A, first retainer arms 222 that protrude downward are formed on lower rear portions of two side walls of the retainer 220. First locking projections 223 are formed at tip ends of the first retainer arms 222. Second locking arms 224 that protrude downward are formed on lower front portions of the two side walls of the retainer 220. Second locking projections 225 are formed at tip ends of the second locking arms 224.

The retainer 220 can be locked to the housing 210 in a temporary locking position shown in FIGS. 12A to 12D that allows insertion of the contacts (not shown) into the contact accommodating cavities (not shown) and in a main locking position shown in FIGS. 12E and 12F that secures the contacts (not shown) in the housing 210. The temporary locking position consists of a first temporary locking position P1 shown in FIGS. 12A and 12B and a second temporary locking position P2 shown in FIGS. 12C and 12D that are successively different in a direction of insertion depth.

As shown in FIG. 12B, when the retainer 220 is in the first temporary locking position P1, temporary locking projections 221 that protrude to an outside from both side walls of the retainer 220 enter into the first locking openings 211 in the housing 210 and restrict vertical movement of the retainer 220. As shown in FIG. 12A, when the retainer 220 is in the first temporary locking position P1, the first locking projections 223 of the retainer 220 are positioned above the first locking members 213 of the housing 210 and restrict downward movement of the retainer 220.

As is shown in FIG. 12D, when the retainer 220 is in the second temporary locking position P2, the temporary locking projections 221 enter into the second locking openings 212 in the housing 210. At the same time, the first locking projections 223 are positioned beneath the first locking members 213 of the housing 210, as shown in FIG. 12C, and restrict upward movement of the retainer 220. The second locking projections 225 are positioned above the second locking members 214 of the housing 210 and restrict the downward movement of the retainer 220. Accordingly, the force that holds the retainer 220 in the temporary locking position is greater when the retainer is in the first temporary locking position P1 than in the second temporary locking position P2.

As shown in FIG. 12F, when the retainer 220 is in the main locking position, the temporary locking projections 221 are still positioned inside the second locking openings 212. Further, as shown in FIG. 12E, the second locking projections 225 are positioned beneath the second locking members 214 of the housing 210 and restrict the upward movement of the retainer 220.

FIGS. 13A to 13C (Japanese Patent Application Kokai No. 2002-260766) show a third conventional electrical connector 301. The electrical connector 301 includes an insulating housing 310. A plurality of contact accommodating cavities 311 for accommodating contacts 320 are formed in the housing 310. As shown in FIG. 3C, an inner peripheral wall member 315 is formed inside the housing 310. The inner peripheral wall member 315 protrudes forward from the contact accommodating cavities 311. Locking members 312 that correspond to the contact accommodating cavities 311 are formed to protrude forward inside the inner peripheral wall member 315. A locking arm 313 that has a locking opening 314 is formed on the inner peripheral wall member 315.

A retainer 330 is inserted from a front surface (left side in FIG. 13A) of the housing 310 and secures the contacts 230 in the housing 310. The retainer 330 is constructed so that it is inserted over the outer periphery of the inner peripheral wall member 315. The retainer 330 can be locked to the housing 310 in a temporary locking position shown in FIG. 13A that allows insertion of the contacts 320 into the contact accommodating cavities 311 and in a main locking position shown in FIG. 13C that secures the contacts 320 in the housing 310. A plurality of receptacle accommodating openings 331 that accommodate receptacles 321 of the contacts 320 are formed in the retainer 330. A lance 332 that initially secures the contacts 320 is disposed in each of the receptacle accommodating openings 331. Lance receiving openings 333 that permit flexing of the lances 332 are disposed above the respective lances 332. A first locking projection 334 and a second locking projection 335 protrude from a bottom portion of the retainer 330.

As shown in FIG. 13B, when the retainer 330 is in the temporary locking position, the first locking projection 334 is positioned to a front of the locking arm 313 and prevents the retainer 330 from being pushed toward a rear of the housing 310. As shown in FIG. 13B, when the retainer 330 is in the temporary locking position, the second locking projection 335 enters into the locking opening 314 of the locking arm 313 and prevents the retainer 330 from being pulled out in the forward direction. Because a back surface 334*a* of the first locking projection 334 is formed as a reversed tapered surface as shown in FIG. 13B, when a pressing force is applied to a front end surface of the locking arm 313, locking is reinforced. Consequently, the retainer 330 that is in the temporary locking position cannot be easily pushed into the main locking position.

As shown in FIG. 13C, when the retainer 330 is in the main locking position, the first locking projection 334 enters into the locking opening 314 of the locking arm 313 and prevents the retainer 330 from being pulled out in the forward direction. When the retainer 330 is moved to the main locking position, as shown in FIG. 13C, the retainer arms 312 of the housing 310 advance into the lance receiving openings 333 of the retainer 330 and prevent the upward movement of the lances 332 to ensure that the contacts 320 are prevented from slipping out of the housing 310.

The following problems have been encountered in the above-described conventional electrical connectors. In the first electrical connector 101, since the locking arm 113 possesses flexibility, the retainer 120 that is in the temporary locking position can easily be moved to the main locking position. Accordingly, there are cases in which the retainer 120 that is in the temporary locking position is unintentionally moved to the main locking position as a result of, for example, foreign matter or the like contacting the locking arm 113.

In the second electrical connector 201, in order to hold the retainer 220 in the second temporary locking position P2, the first retainer arms 222 that are disposed on the lower rear portions of the two side walls of the retainer 220 restrict upward movement of the retainer 220. The second locking arms 224 disposed on the lower front portions of the two side walls of the retainer 220 restrict downward movement of the retainer 230. Therefore, two kinds of locking arms are needed, which requires a large amount of space. Moreover, since there are two temporary locking positions, there is a danger that the second locking position P2 will erroneously be recognized as the main locking position.

In the third electrical connector 310, although the retainer 330 can not be easily pushed from the temporary locking position into the main locking position, it is difficult to set the angle of inclination of the back surface 334*a* of the first locking projection 334 so that the locking arm 313 is not damaged when moving the retainer 330 from the temporary locking position to the main locking position.

SUMMARY OF THE INVENTION

It is therefore an object of the present invention to provide an electrical connector that can prevent any unintentional movement of the retainer from the temporary locking position to the main locking position without making the retainer susceptible to damage or requiring a large amount of space.

This and other objects are achieved by an electrical connector comprising an insulating housing and a retainer. The housing has a plurality of contact accommodating cavities. The retainer is moveable between a temporary locking position and a main locking position. The retainer has first retainer arms that extend into a front surface of the housing. The first retainer arms have a second locking member formed on a top surface in a vicinity of a free end of the first retainer arms and a third locking member formed on a bottom surface in substantially a center of the first retainer arms. The second and third locking members are configured to abut the housing in the temporary locking position so that the retainer is prevented from moving from the temporary locking position to the main locking position.

DETAILED DESCRIPTION OF THE INVENTION

Figure 1:
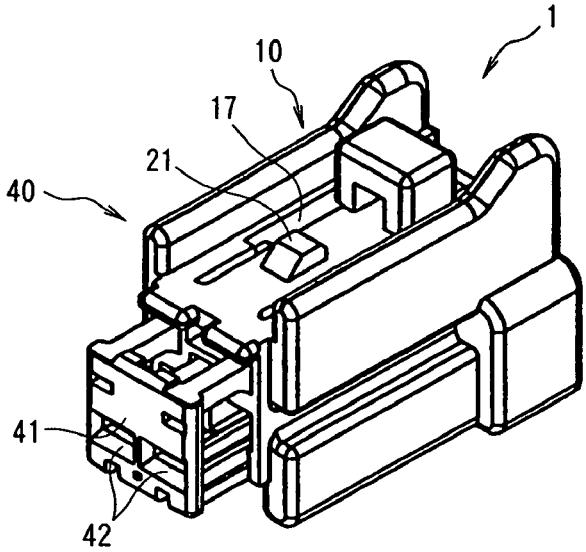
FIG. 1 is a perspective view of an electrical connector of the present invention showing a retainer in a temporary locking position.
Figure 5A:
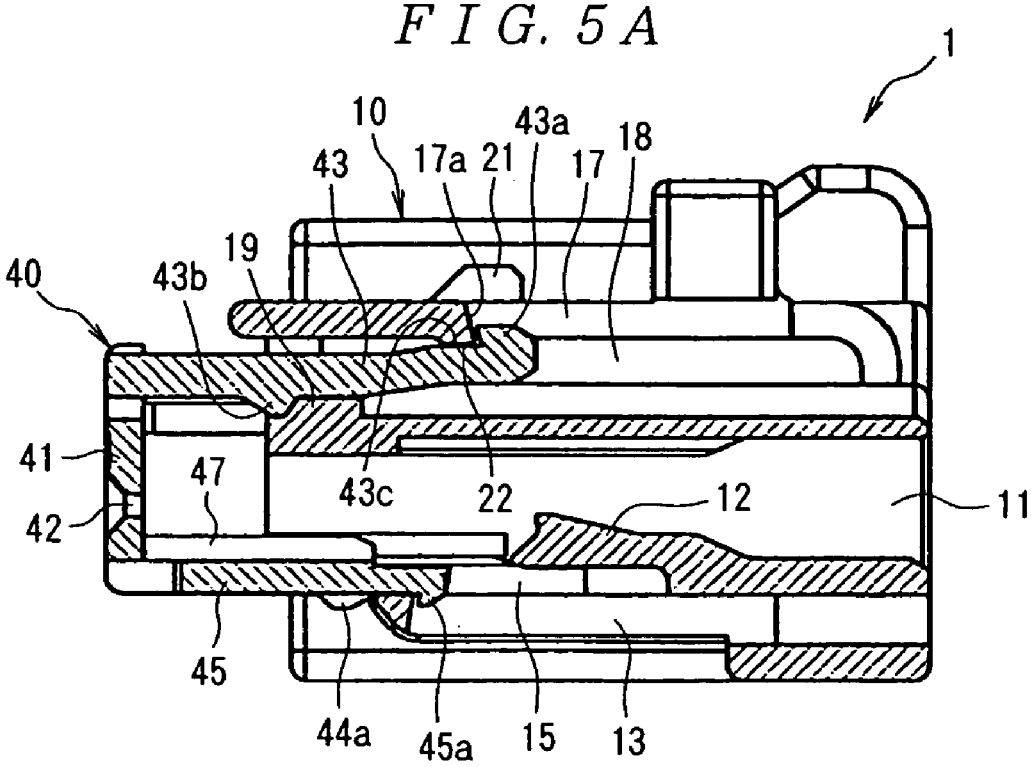
FIG. 5A is a sectional view taken along line 5A—5A of FIG. 2.
Figure 5B:
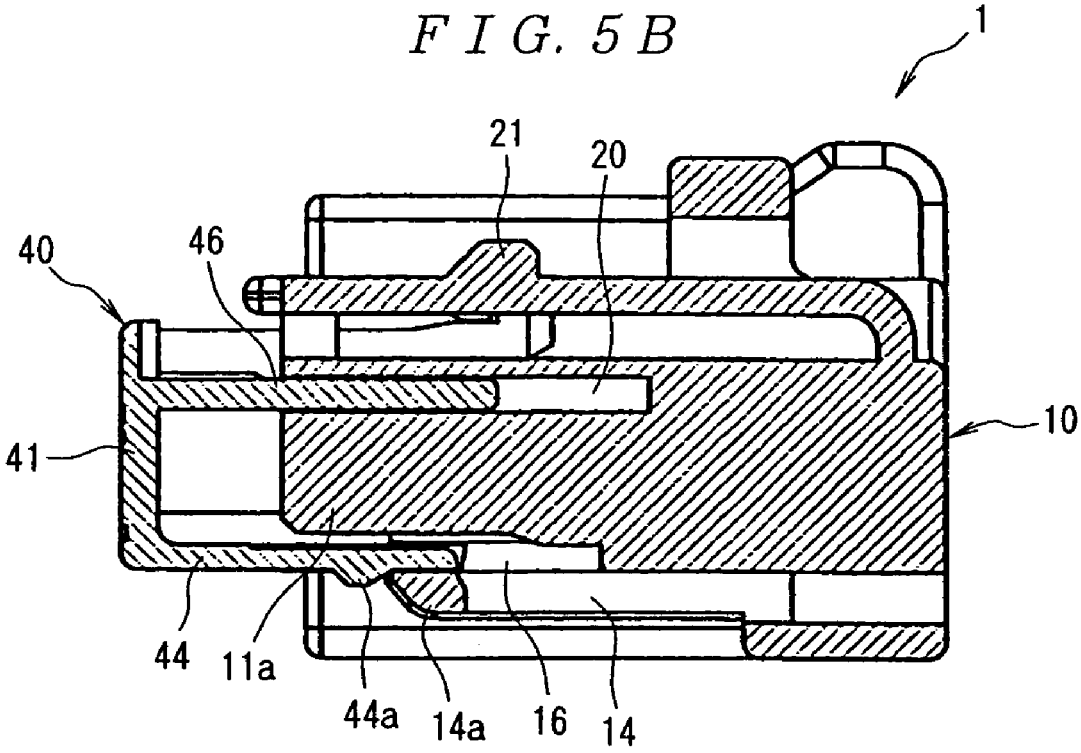
FIG. 5B is a sectional view taken along line 5B—5B of FIG. 2.
Figure 8A:
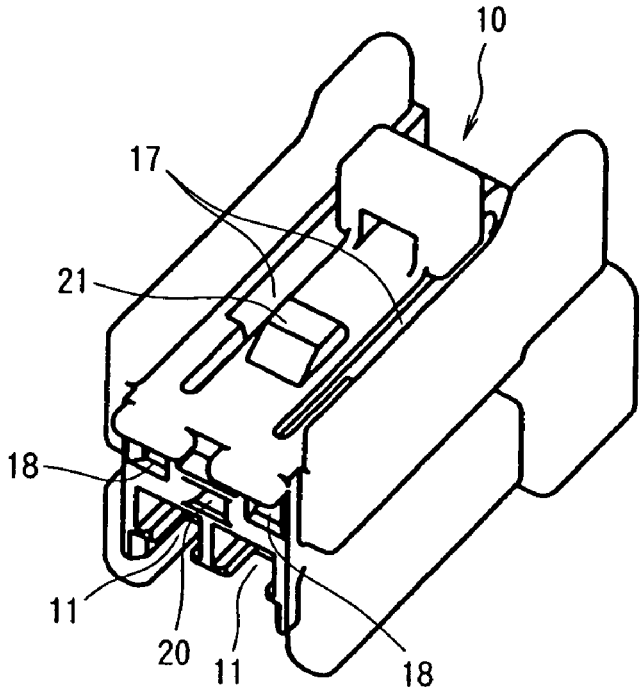
FIG. 8A is a front perspective view taken from above of a housing.
Figure 8B:
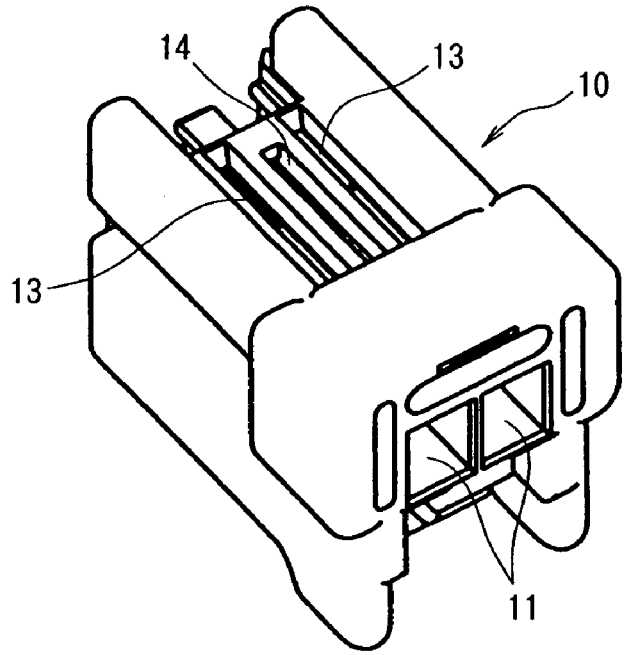
FIG. 8B is a rear perspective view taken from below of the housing.

FIG. 1 shows an electrical connector 1. The electrical connector 1 includes an insulating housing 10 and a retainer 40. The housing 10 has a substantially rectangular shape and is formed by molding an insulating synthetic resin. As shown in FIG. 5A, a plurality of contact accommodating cavities 11 extends in a single row in the housing 10. As shown in FIGS. 8A and 8B, each of the contact accommodating cavities 11 opens on a front side of the housing 10 (left side in FIGS. 1, 8A, and 8B). As shown in FIG. 5B, a partition wall 11*a* that extends in the left-right direction separates the contact accommodating cavities 11.

Figure 3:
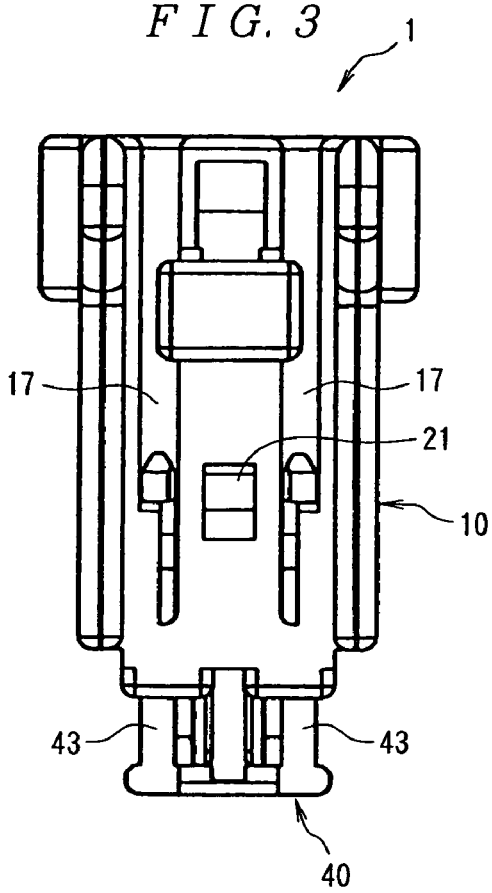
FIG. 3 is a plan view of the electrical connector shown in FIG. 1.
Figure 6A:
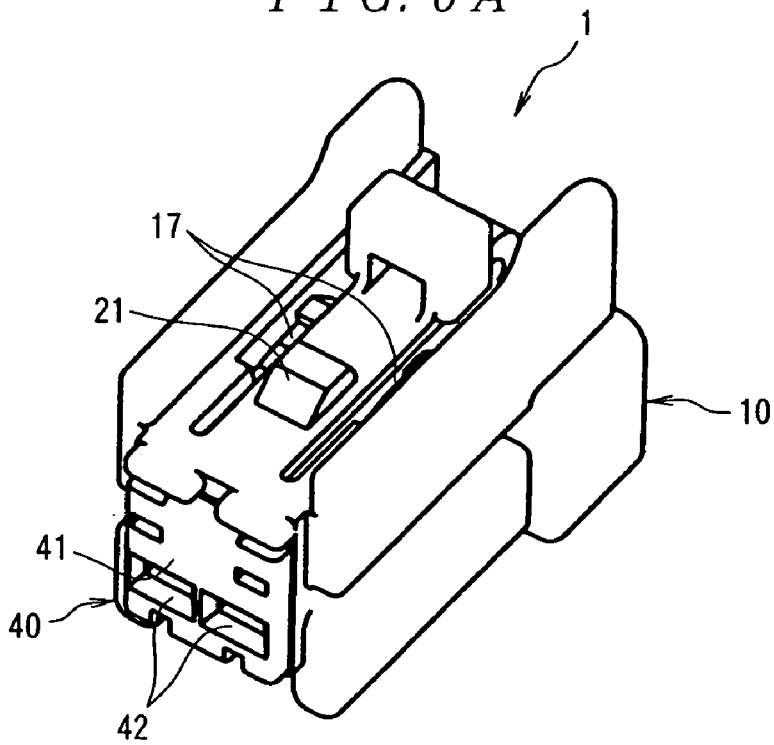
FIG. 6A is a front perspective view taken from above of the electrical connector of the present invention showing the retainer in a main locking position.

As shown in FIG. 3, a plurality of first locking openings 17 that extend in the forward-rearward direction in positions corresponding to the contact accommodating cavities 11 is formed in the top wall of the housing 10. As shown in FIG. 5A, the first locking opening 17 have inclined contact surfaces 17*a*. First retainer arm receiving openings 18 that communicate with the respective first locking openings 17 and that open on the front side of the housing 10 are formed beneath the first locking openings 17. Housing locking projections 19 protrude into lower front ends of the first retainer arm receiving openings 18 from upper front ends of housing walls that define the contact accommodating cavities 11. As shown in FIGS. 5B and 8A, a guide member receiving opening 20 that opens on the front side of the housing 10 is formed between the first retainer arm receiving openings 18. As shown in FIG. 6A, a mating connector locking projection 21 that locks with a mating connector (not shown) is formed on the top wall of the housing 10.

As shown in FIG. 5A, a plurality of second locking openings 13 is formed in a bottom wall of the housing 10 in positions corresponding to the contact accommodating cavities 11. A locking arm 12 is disposed in each of the contact accommodating cavities 11. The locking arms 12 extend forward at an inclination from the bottom wall of the housing 10. Second retainer arm receiving openings 15 that permit flexing of the locking arms 12 are formed beneath the locking arms 12 so that the second retainer arm receiving openings 15 communicate with the second locking openings 13.

Figure 6B:
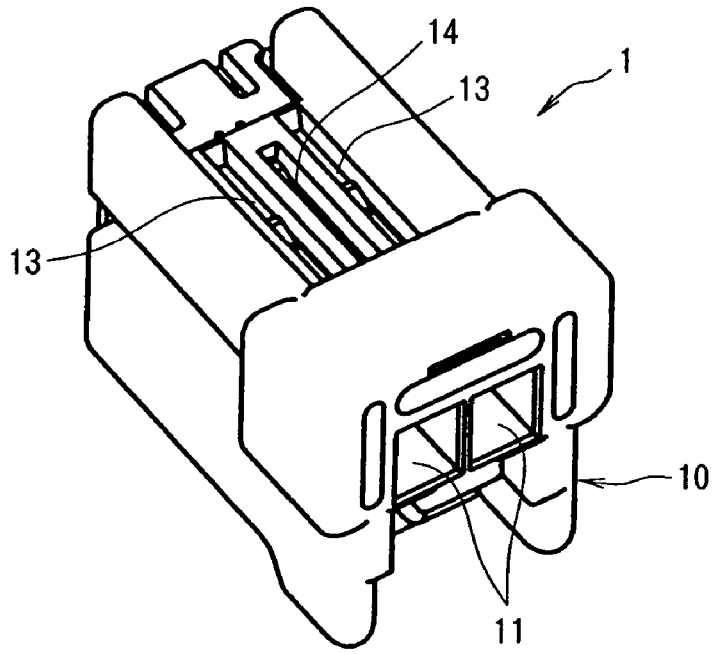
FIG. 6B is a rear perspective view taken from below of the electrical connector of the present invention showing the retainer in the main locking position.

As shown in FIG. 5B and 6B, a third locking opening 14 is formed in a position corresponding to the partition wall 11*a* and is formed in a central member (in the left-right direction) of the bottom wall of the housing 10. As shown in FIG. 5B, the third locking opening 14 has a front portion 14*a*. A third retainer arm receiving opening 16 that communicates with the third locking opening 14 and that opens on the front side of the housing 10 is formed above the third locking opening 14.

Figure 7A:
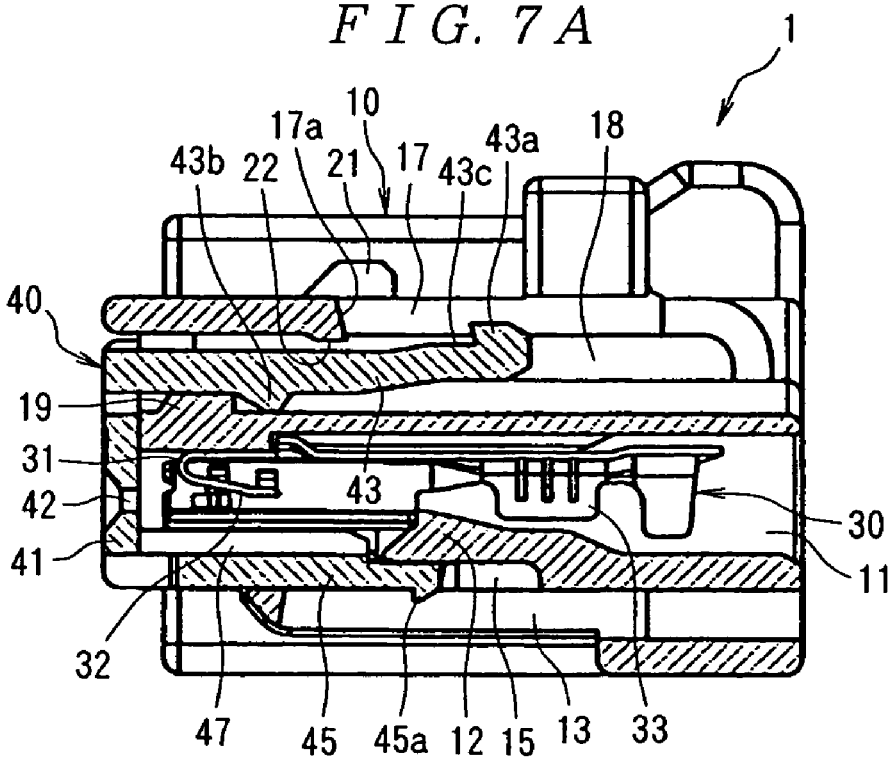
FIG. 7A is a sectional view taken along the same line as line 5A—5A of FIG. 2 of the electrical connector shown in FIG. 6A.

As shown in FIG. 7A, contacts 30 are arranged in the contact accommodating cavities 11. Each of the contacts 30 is formed by stamping and forming a metal plate. Each of the contacts 30 has a substantially box-like receptacle 31 that is secured by the corresponding locking arms 12. An electrical wire connecting member 33 extends rearward from the receptacle 31 and is connected by crimping to an electrical wire (not shown). An elastic contact member 32 that makes elastic contact with a mating male contact (not shown) is disposed inside the receptacle 31.

Figure 2:
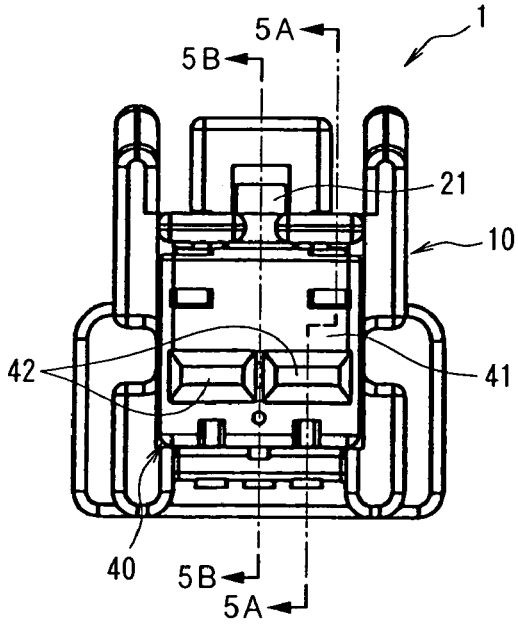
FIG. 2 is a front view of the electrical connector shown in FIG. 1.
Figure 9A:
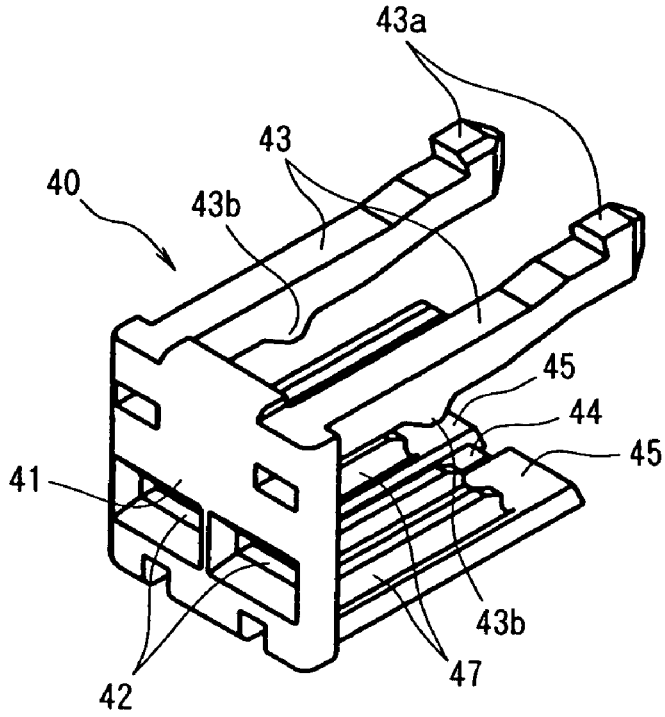
FIG. 9A is a front perspective view taken from above of the retainer.
Figure 9B:
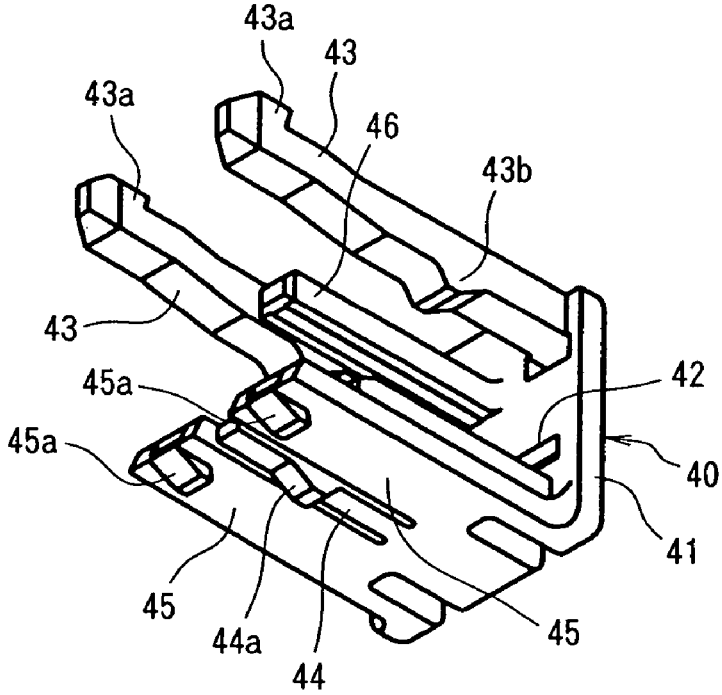
FIG. 9B is a rear perspective view taken from below of the retainer.
Figure 10:
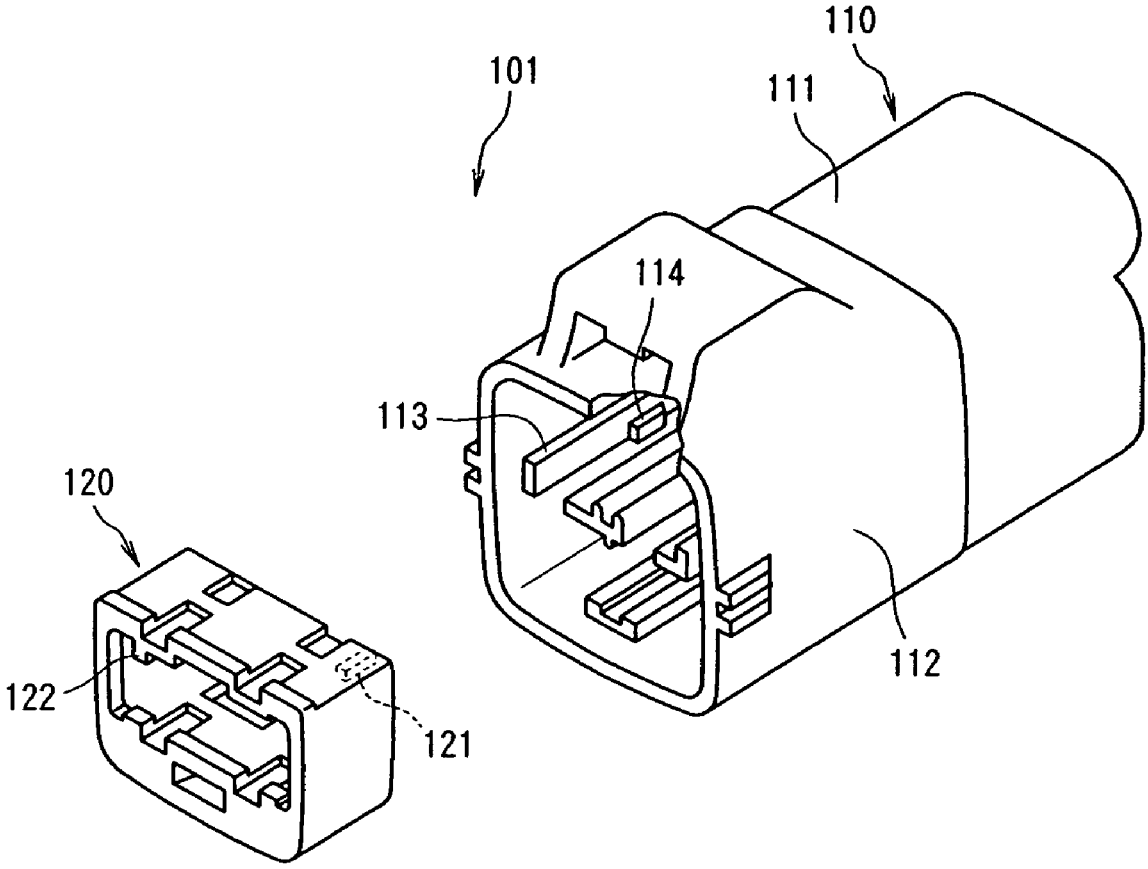
Prior Art F I G. 10
FIG. 10 is a perspective view of a first conventional electrical connector.
Figure 11A:
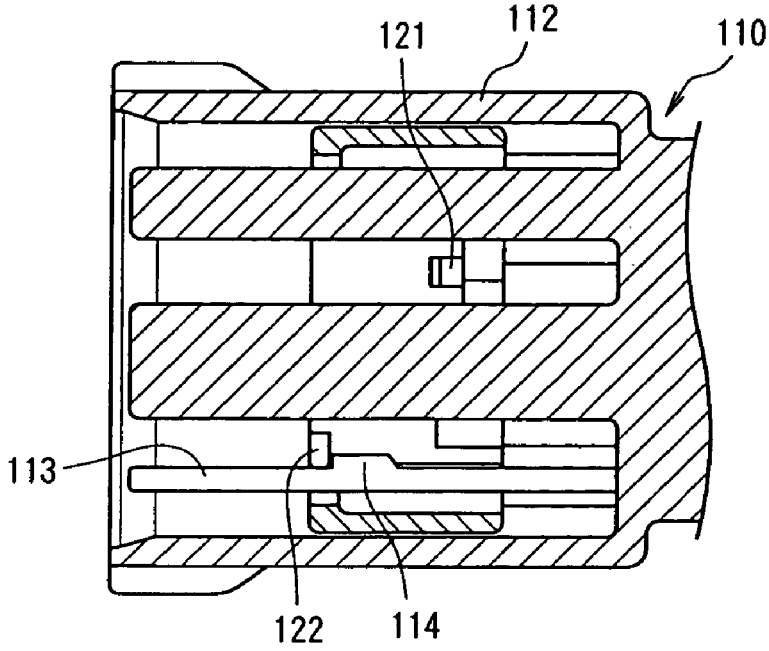
Prior Art F I G. 11 A
FIG. 11A is a sectional view of the first conventional electrical connector shown in FIG. 10 showing a retainer in a temporary locking position.
Figure 11B:
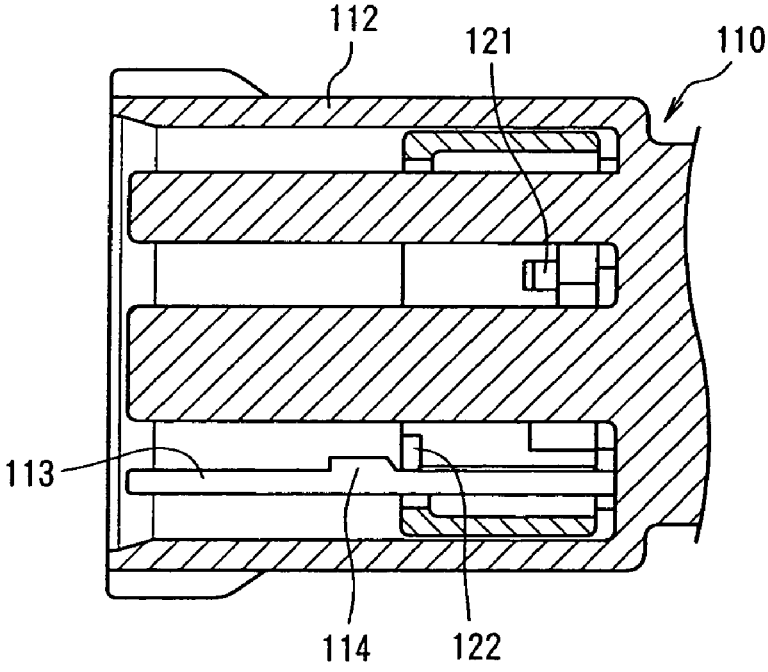
Prior Art F I G. 11 B
FIG. 11B is a sectional view of the first conventional electrical connector shown in FIG. 10 showing the retainer in a main locking position.
Figure 12A:
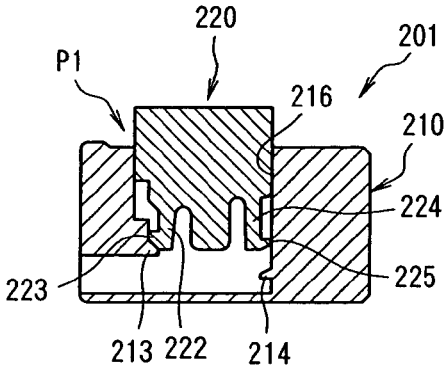
Prior Art FIG. 12A
FIGS. 12A to 12F are sectional views of a second conventional electrical connector.
Figure 12C:
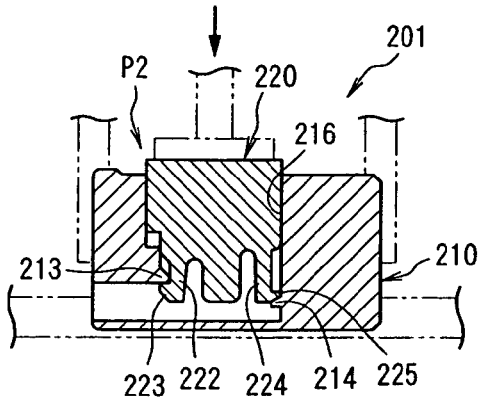
Prior Art FIG. 12C
Figure 12B:
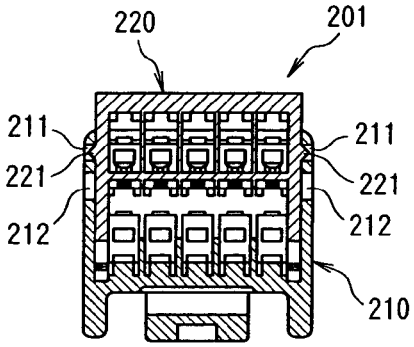
Prior Art FIG. 12B
Figure 12D:
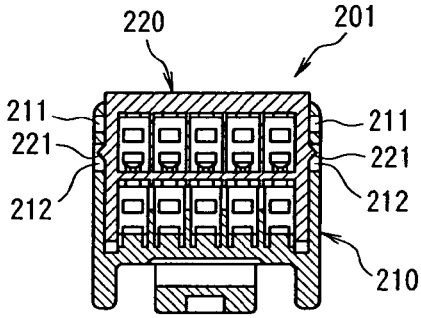
Prior Art FIG. 12D
Figure 12E:
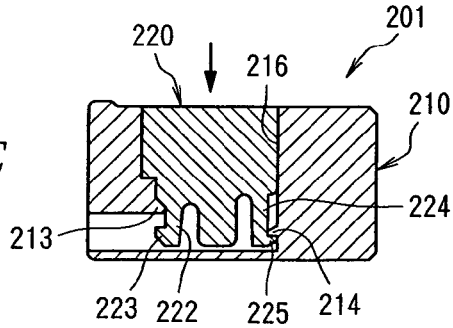
Prior Art FIG. 12E
Figure 12F:
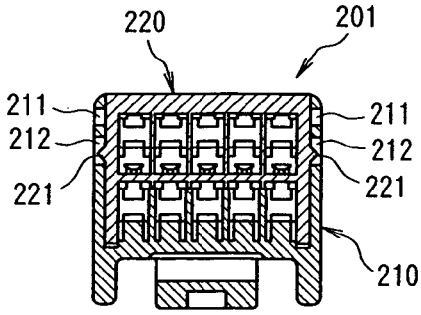
Prior Art FIG. 12F
Figure 13A:
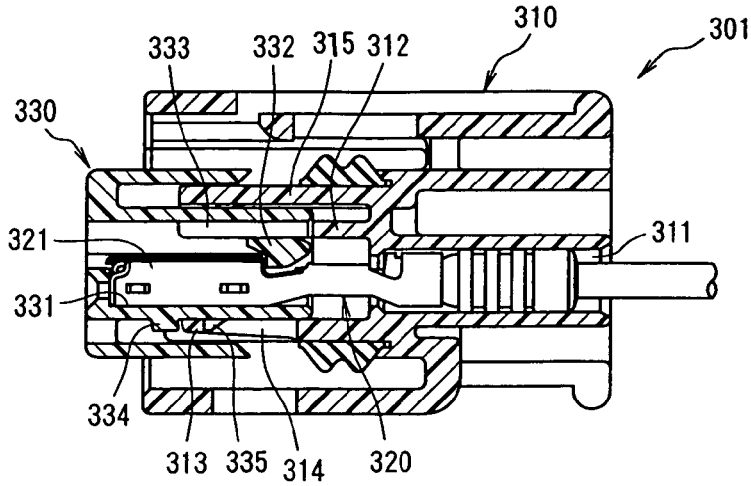
Prior Art FIG. 13A
FIGS. 13A to 13C are sectional views of a third conventional electrical connector.
Figure 13B:
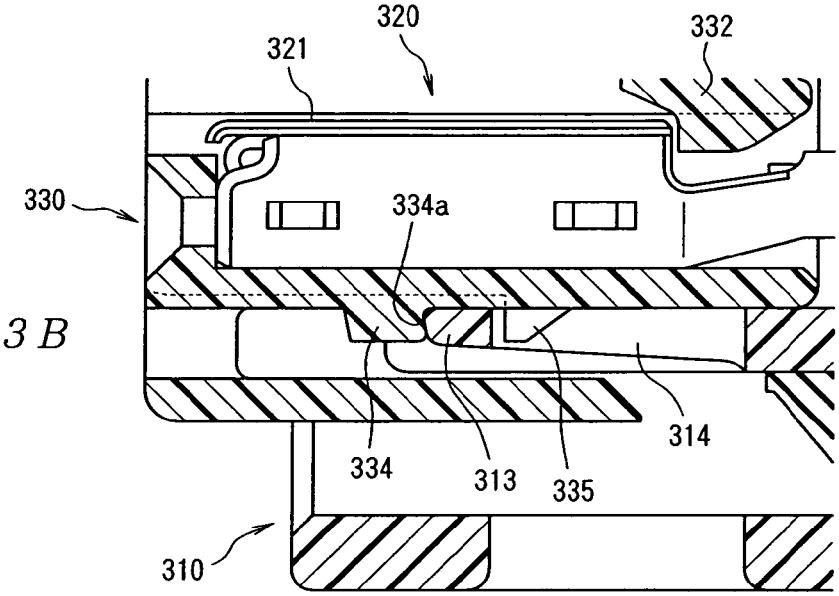
Prior Art FIG. 13B
Figure 13C:
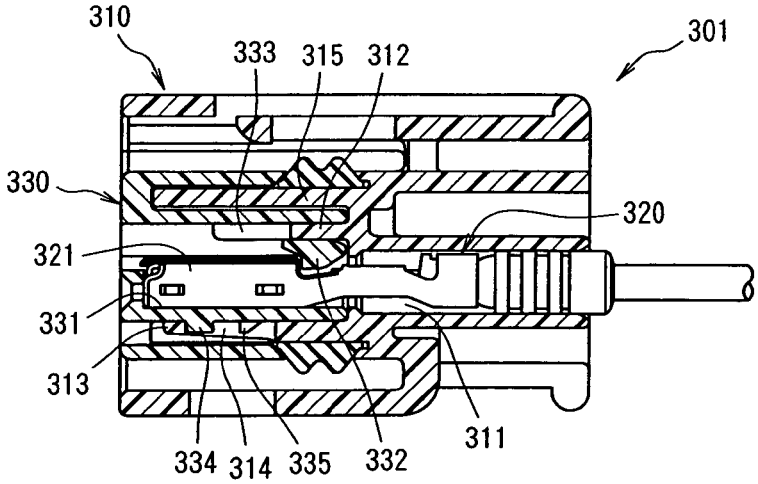
Prior Art FIG. 13C

As shown in FIGS. 2, 9A, and 9B, the retainer 40 has a rectangular front plate 41 that extends in the direction of length (left-right direction in FIG. 1) to cover the front surface of the housing 10. The front plate 41 has a plurality of contact though-holes 42 formed in a single row in positions corresponding to the contact accommodating cavities 11. A guide member 46 extends rearward from the front plate 41 and protrudes from substantially a center of a back surface of the front plate 41. A plurality of first retainer arms 43 extends rearward from an upper end of the front plate 41, and a plurality of second retainer arms 45 extends rearward from a lower end of the front plate 41. A third retainer arm 44 is formed between the second retainer arms 45 and extends from the lower end of the front plate 41. The first retainer arms 43 are disposed in the left-right direction in positions corresponding to the first retainer arm receiving openings 18 in the housing 10. The second retainer arms 45 are disposed in the left-right direction in positions corresponding to the second retainer arm receiving openings 15 in the housing 10. The third retainer arms 44 are disposed in the left-right direction in positions corresponding to the third retainer arm receiving openings 16 in the housing 10.

Each of the first retainer arms 43 has a first locking member 43*a* with an inclined surface on a free end thereof. A second locking member 43*b* is formed in substantially a center of the first retainer arms 43. A third locking member 43*c*, as shown in FIG. 7A, is formed adjacent to the first locking member 43*a*. The first locking members 43*a* and third locking members 43*c* are provided on top surfaces of the first retainer arm 43. The second locking members 43*b* are provided on bottom surfaces of the first retainer arms 43. As shown in FIG. 9A, abutment members 47 protrude from top surfaces of the second retainer arms 45. As shown in FIG. 9B, locking projections 45*a* protrude downward from rear ends of the second retainer arms 45. Locking protrusions 44*a* protrude downward from bottom surfaces of the third retainer arms 44 and are formed substantially in a center thereof.

Figure 4:
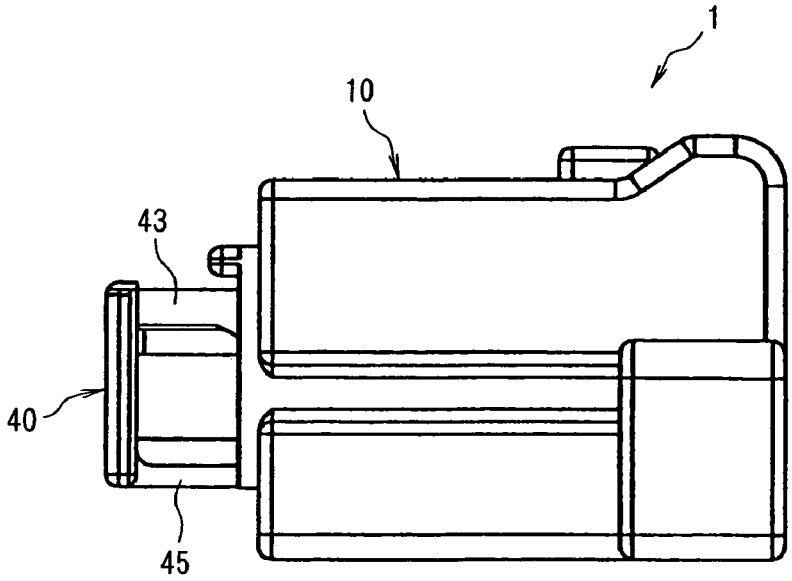
FIG. 4 is a right side view of the electrical connector shown in FIG. 1.

A method for assembling the electrical connector 1 will now be described in greater detail. As shown in FIG. 4, the retainer 40 is inserted from the front surface of the housing 10, and is moveable between a temporary locking position shown in FIGS. 5A and 5B that allows insertion of the contacts 30 into the housing 10 and a main locking position shown in FIGS. 7A and 7B that secures the contacts in the housing 10.

The retainer 40 is first positioned in the temporary locking position shown in FIGS. 5A and 5B. In the temporary locking position, the guide member 46 is received in the guide member receiving opening 20 from the front surface of the housing 10 to prevent movement of the retainer 40 in the vertical direction, which may be caused by any looseness. The first retainer arms 43 are received in the front surface of the housing 10 so that the first locking members 43*a* enter into the first locking openings 17 in the housing 10. The inclined surfaces of the first locking members 43*a* engage the inclined contact surface 17*a* so that the retainer 40 is prevented from being pulled out in the forward direction. The third locking members 43*c* of the first retainer arms 43 abut bottom surfaces of the protruding members 22 of the housing 10. Because the inclined surfaces of the first locking members 43*a* and the inclined contact surface 17*a* are oriented to oppose the direction in which the retainer 40 can be pulled out of the housing 10, the retainer 40 strongly resists being pulled out of the housing 10 from the temporary locking position. The second locking members 43*b* are positioned on the front side of the housing locking projections 19 and prevent the retainer 40 from being pushed toward the rear of the housing 10. In the temporary locking position, the second locking members 43*b* of the first retainer arms 43 contact a front side of the housing locking projections 19 and the top surface of the housing 10.

The second retainer arms 45 advance into the second retainer arm receiving openings 15 from the front surface of the housing 10. The locking projections 45*a* enter into the second locking openings 13 of the housing 10, as shown in FIG. 5A, so that the retainer 40 is prevented from being pulled out in the forward direction. The contact surfaces of each of the locking projections 45*a* and each of the second locking openings 13 are formed as inclined surfaces that are oriented to oppose the direction in which the retainer 40 is pulled out.

The third retainer arms 44 advance into the third retainer arm receiving openings 16 from the front surface of the housing 10. The locking protrusion 44*a* is positioned on a front side of the front portion 14*a* of the third locking opening 14, as shown in FIG. 5B, so that the retainer 40 is prevented from being pushed toward the rear of the housing 10.

When the retainer 40 is in the temporary locking position, the contacts 30, which have electrical wires (not shown) connected thereto, are inserted into the contact accommodating cavities 11 from the rear side of the housing 10. As a result, the locking arms 12 are positioned on rear sides of the receptacles 31 of the contacts 30, so that the contacts 30 are tentatively secured from slipping out of the housing 10.

Figure 7B:
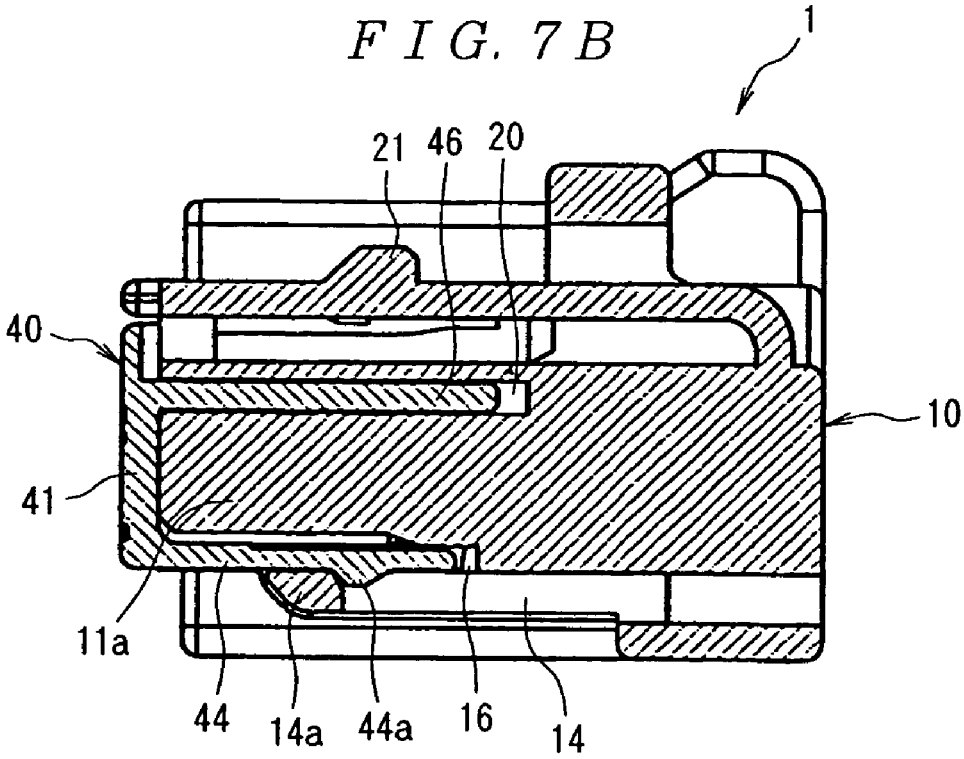
FIG. 7B is a sectional view taken along the same line as line 5B—5B of FIG. 2 of the electrical connector shown in FIG. 6A.

The retainer 40 is then pushed toward the rear of the housing 10 to move the retainer 40 from the temporary locking position to the main locking position shown in FIGS. 7A and 7B. In the main locking position, the first locking members 43*a* and the second locking members 43*b* are arranged inside the first retainer arm receiving openings 18, as shown in FIG. 7A. The second retainer arms 45 advance into the second retainer arm receiving openings 15 formed beneath the locking arms 12. The second retainer arms 45 thereby restrict the downward movement of the locking arms 12 to secure the contacts 30 in the housing 10. The abutment members 47 restrict the downward movement of the receptacles 31 of the contacts 30 in the main locking position. The locking protrusions 44*a* of the third retainer arms 44 enter into the third locking openings 14, as shown in FIG. 7B, so that the retainer 40 is prevented from being pulled out toward the front of the housing 10. As a result, the assembly of the electrical connector 1 is completed.

In the electrical connector 1 of the present invention, in the temporary locking position, the first retainer arms 43 are supported in the housing 10 at two positions, by the second locking members 43*b* and by the third locking members 43*c*. It is therefore possible to prevent the retainer 40 from being moved unintentionally from the temporary locking position to the main locking position. Additionally, because the retainer 40 is secured in the temporary locking position by the first retainer arms 43, a large space is not required. Moreover, the flexibility of the first retainer arms 43 is restricted in the temporary locking position, since the third locking members 43*c* are provided on the top surfaces of the first retainer arms 43, and the second locking members 43*b* are provided on the bottom surfaces of the first retainer arms 43. Consequently, any unintentional movement of the retainer 40 from the temporary locking position to the main locking position can further be prevented. Further, in the temporary locking position, the top surfaces of the first locking members 43*a* are exposed to the outside of the housing 10 by the first locking openings 17. Accordingly, the retainer 40 can be separated from the housing 10 by pressing the first locking members 43*a* downward with a tool or the like.

An embodiment of the present invention was described herein. The present invention, however, is not limited to this embodiment. Various alterations and modifications are possible. For example, the number of the first retainer arms 43 does not have to be identical to the number of the contact accommodating cavities 11. The number of the first retainer arms 43 may be larger or smaller than the number of the contact accommodating cavities 11.

We claim:

1. An electrical connector comprising:

an insulating housing having a plurality of contact accommodating cavities;

a retainer moveable between a temporary locking position and a main locking position, the retainer having first retainer arms that extend into a front surface of the housing, the first retainer arms having a second locking member formed on a top surface in a vicinity of a free end of the first retainer arms and a third locking member formed on a bottom surface in substantially a center of the first retainer arms, the second and third locking members being configured to abut the housing in the temporary locking position so that the retainer is prevented from moving from the temporary locking position to the main locking position, the free end of the first retainer arms including a first locking member configured to abut the housing in the temporary locking position so that the retainer is prevented from being removed from the housing; and the housing including first locking openings formed in a top wall of the housing adjacent to a first locking member that exposes the first locking member to an outside of the housing.

2. The electrical connector of claim 1, wherein the first locking member has an inclined surface.

3. The electrical connector of claim 1, wherein the retainer includes second retainer arms that extend into the front surface of the housing and abut locking arms disposed in the contact accommodating cavities in the main locking position.

4. The electrical connector of claim 3, wherein the second retainer arms include locking projections configured to abut the housing in the temporary locking position so that the retainer is prevented from being removed from the housing.

5. The electrical connector of claim 3, further comprising contacts arranged in the contact accommodating cavities, the contacts having a receptacle and an electrical wire connecting member, the contacts being receivable in the contact accommodating cavities when the retainer is in the temporary locking position and being secured in the housing by the locking arms when the retainer is in the main locking position.

6. The electrical connector of claim 5, wherein the second retainer arms include abutment members that abut the receptacles in the main locking position.

7. The electrical connector of claim 3, wherein the retainer includes third retainer arms that extend into the front surface of the housing, the third retainer arms having locking protrusions configured to abut the housing in the main locking position so that the retainer is prevented from being removed from the housing.

8. The electrical connector of claim 7, wherein the third retainer arms are disposed between the second retainer arms.

9. The electrical connector of claim 1, wherein the retainer includes a guide member that extends into the front surface of the housing.

10. The electrical connector of claim 1, wherein the housing limits the movement of the second locking member in a direction substantially parallel to a direction of insertion of the retainer into the housing and the housing limits the movement of the third locking member in a direction substantially perpendicular to the direction of insertion of the retainer into the housing.

11. An electrical connector comprising:

an insulating housing having a plurality of contact accommodating cavities; and a retainer moveable between a temporary locking position and a main locking position, the retainer having first retainer arms that extend from an upper end of the retainer into a front surface of the housing and second retainer arms formed on a lower end of the retainer that extend into the front surface of the housing, the first retainer arms having a second locking member formed on a top surface in a vicinity of a free end of the first retainer arms and a third locking member formed on a bottom surface in substantially a center of the first retainer arms, the second and third locking members being configured to abut the housing in the temporary locking position so that the retainer is prevented from moving from the temporary locking position to the main locking position, the second retainer antis being configured to abut locking arms disposed in the contact accommodating cavities in the main locking position.

12. The electrical connector of claim 11, wherein the free end of the first retainer arms includes a first locking member configured to abut the housing in the temporary locking position so that the retainer is prevented from being removed from the housing.

13. The electrical connector of claim 12, wherein the first locking member has an inclined surface.

14. The electrical connector of claim 12, wherein the housing includes first locking openings formed in a top wall of the housing adjacent to the first locking member that exposes the first locking member to an outside of the housing.

15. The electrical connector of claim 11, wherein the second retainer arms include locking projections configured to abut the housing in the temporary locking position so that the retainer is prevented from being removed from the housing.

16. The electrical connector of claim 11, further comprising contacts arranged in the contact accommodating cavities, the contacts having a receptacle and an electrical wire connecting member, the contacts being receivable in the contact accommodating cavities when the retainer is in the temporary locking position and being secured in the housing by the locking arms when the retainer is in the main locking position.

17. The electrical connector of claim 16, wherein the second retainer arms include abutment members that abut the receptacles in the main locking position.

18. The electrical connector of claim 11, wherein the retainer includes third retainer arms that extend into the front surface of the housing, the third retainer arms having locking protrusions configured to abut the housing in the main locking position so that the retainer is prevented from being removed from the housing.

19. The electrical connector of claim 18, wherein the third retainer arms are disposed between the second retainer arms.

20. The electrical connector of claim 11, wherein the retainer includes a guide member that extends into the front surface of the housing.

21. The electrical connector of claim 11, wherein the housing limits the movement of the second locking member is a direction substantially parallel to a direction of insertion of the retainer into the housing and the housing limits the movement of the third locking member in a direction substantially perpendicular to the direction of insertion of the retainer into the housing.

* * * * *

UNITED STATES PATENT AND TRADEMARK OFFICE

CERTIFICATE OF CORRECTION

PATENT NO. : 7,114,997 B2
APPLICATION NO. : 10/963904
DATED : October 3, 2006
INVENTOR(S) : Tetsuya Sagawa et al.

It is certified that error appears in the above-identified patent and that said Letters Patent is hereby corrected as shown below:

Correct claim 1, line 21 “a first locking member” should read --the first locking member-- to correct a typographical error.

Correct claim 11, line 18, “the second retainer antis being” should read --the second retainer arms being-- to correct a typographical error.

Correct claim 21, line 3, “is a direction” should read --in a direction-- to correct a typographical error.

Signed and Sealed this

Second Day of January, 2007

JON W. DUDAS
*Director of the United States Patent and Trademark Office*